US006795103B2

(12) United States Patent
Okayasu et al.

(10) Patent No.: US 6,795,103 B2
(45) Date of Patent: Sep. 21, 2004

(54) THERMAL PRINTER HAVING THERMALLY ACTIVATING APPARATUS FOR HEAT-SENSITIVE ADHESIVE SHEET

(75) Inventors: Takanori Okayasu, Chiba (JP); Shinichi Yoshida, Chiba (JP)

(73) Assignee: SII P & S Inc., Chiba (JP)

( * ) Notice: Subject to any disclaimer, the term of this patent is extended or adjusted under 35 U.S.C. 154(b) by 0 days.

(21) Appl. No.: 10/434,321

(22) Filed: May 8, 2003

(65) Prior Publication Data

US 2004/0017434 A1 Jan. 29, 2004

(30) Foreign Application Priority Data

Jun. 5, 2002 (JP) ..... 2002-164276

(51) Int. Cl.[7] ..... B41J 2/37
(52) U.S. Cl. ..... 347/192
(58) Field of Search ..... 347/192, 185, 347/14, 194–196

(56) References Cited

U.S. PATENT DOCUMENTS 4,442,342 A * 4/1984 Yoneda ..... 347/192
5,359,352 A * 10/1994 Saita et al. ..... 347/62
5,451,988 A * 9/1995 Ono ..... 347/185
6,476,838 B1 * 11/2002 Italiano ..... 347/192
6,663,209 B2 * 12/2003 Yoshida ..... 347/14

* cited by examiner

*Primary Examiner*—Lamson Nguyen
*Assistant Examiner*—K. Feggins
(74) *Attorney, Agent, or Firm*—Adams & Wilks

(57) ABSTRACT

There are provided a power-consumption estimating means (a microcomputer M and a designated program) for estimating first electric power consumption required for driving a printing thermal head (10) and second electric power consumption required for driving an activating thermal head (40) of a thermally activating apparatus; a supply-power setting means (the microcomputer M and a designated program) for setting first electric power that can be supplied to the printing thermal head and second electric power that can be supplied to the activating thermal head within the allowable power range on the basis of the first electric power consumption and the second electric power consumption estimated by the power-consumption estimating means; and an energization control means (the microcomputer M and a designated program) for energizing the printing thermal head and the activating thermal head on the basis of the first electric power and the second electric power set by the supply-power setting means.

8 Claims, 5 Drawing Sheets

THERMAL PRINTER HAVING THERMALLY ACTIVATING APPARATUS FOR HEAT-SENSITIVE ADHESIVE SHEET

BACKGROUND OF THE INVENTION

1. Field of the Invention

The present invention relates to a thermal printer including a thermally activating apparatus for a heat-sensitive adhesive sheet having a heat-sensitive adhesive layer that exhibits a non-bonding property normally and expresses a bonding property by heat on one side of a sheet-like substrate, and more particularly, relates to a technique capable of efficiently driving a printing thermal head and an activating thermal head with limited allowable electric power.

2. Description of the Related Art

Heat-sensitive adhesive sheets (heat-sensitive adhesive labels) as one type of so-called linerless labels have recently been used in broad areas, such as adhesion of POS labels for food, distribution/delivery labels, medical labels, baggage tags, and indicator labels for bottles and cans. The heat-sensitive adhesive labels are constructed such that a heat-sensitive adhesive layer which exhibits a non-bonding property normally and expresses a bonding property by heat is formed on the back of a sheet-like label substrate (for example, base paper) and a printable plane is formed on the front surface.

The heat-sensitive adhesive has a thermoplastic resin, a solid plasticizer or the like as the main component, and exhibits a non-bonding property normally but expresses a bonding property by being activated when heated with a thermally activating apparatus. The activating temperature is normally from 50 to 150° C., wherein in this temperature range, the solid plasticizer in the heat-sensitive adhesive melts to give a bonding property to the thermoplastic resin. The melted solid plasticizer is gradually crystallized through a supercooled state; thus, the bonding property is maintained for a fixed period of time. While the bonding property is maintained, the adhesive label is used in the manner of being adhered to the object such as a glass bottle.

The printable plane of the heat-sensitive adhesive label is composed of, for example, a heat-sensitive color-forming layer, on which a desired character or image is printed with a thermal printer having a general thermal head; thereafter, the heat-sensitive adhesive layer is activated by the thermally activating apparatus.

A printer is also being developed which has the thermally activating apparatus in the thermal printer for performing thermal printing onto a heat-sensitive adhesive label and activation of a heat-sensitive adhesive layer in succession.

Such a printer had, for example, an arrangement shown in FIG. 6.

In FIG. 6, reference sign P2 denotes a thermal printer unit; sign C2 denotes a cutter unit; sign A2 denotes a thermally activating unit; and sign R denotes a heat-sensitive adhesive label wound like a roll.

The thermal printer unit P2 includes a printing thermal head 100, a platen roller 101 which is brought into pressure contact with the printing thermal head 100, and a drive system (for example, an electric motor and a gear train or the like), which is not shown, for rotating the platen roller 101.

In FIG. 6, the platen roller 101 is rotated in the direction of D1 (clockwise) to draw out the heat-sensitive adhesive label R; the drawn-out heat-sensitive adhesive label R is subjected to thermal printing, and is then carried out in the direction of D2 (to the right). The platen roller 101 includes a pressurizing means (for example, a coil spring, a leaf spring or the like), which is not shown, by the urging force of which the surface of the platen roller 101 is brought into pressure contact with the thermal head 100.

The heat-sensitive adhesive label R is constructed, for example, as in FIG. 7.

More specifically, base paper 1500 serving as a label substrate has a thermal coat layer 1501 serving as a heat-sensitive color-forming layer, which forms a printable plane, on one side (the surface in FIG. 7), on which a colored print layer 1502 having price frames, characters including units, patterns, or the like printed thereon is formed. The other side (the back in FIG. 7) of the base paper 1500 has a heat-sensitive adhesive layer K coated with a heat-sensitive adhesive having a thermoplastic resin, a solid plasticizer, or the like as the main component.

The printing thermal head 100 and the platen roller 101 operate on the basis of a print signal from a print controller (not shown), thereby allowing desired printing onto the thermal coat layer 1501 of the heat-sensitive adhesive label R.

The cutter unit C2 is used for cutting the heat-sensitive adhesive label R that has been subjected to thermal printing with the thermal printer unit P2 in an appropriate length, including a movable blade 200, a fixed blade 201, or the like which are activated by the primary drive such as an electric motor (not shown). The movable blade 200 is driven in a designated timing by the control of a controller (not shown).

The thermally activating unit A2 is rotated by, for example, a primary drive (not shown), including an inserting roller 300 and an ejecting roller 301 for inserting and ejecting the cut heat-sensitive adhesive label R, wherein a thermally activating thermal head 400 and a platen roller 401, which is brought into pressure contact with the thermally activating thermal head 400, are disposed between the inserting roller 300 and the ejecting roller 301. The platen roller 401 includes a drive system, which is not shown, (such as an electric motor and a gear train), wherein the platen roller 401 is rotated in the direction of D4 (counterclockwise in FIG. 6) to transfer the heat-sensitive adhesive label R in the direction of D6 (to the right in FIG. 6) with the inserting roller 300 and the ejecting roller 301, which rotate in the directions of D3 and D5, respectively. The platen roller 401 includes a pressurizing means, which is not shown, (such as a coil spring and a leaf spring), by the urging force of which the surface of the platen roller 401 is brought into pressure contact with the thermally activating thermal head 400.

Reference sign S indicates an ejection detecting sensor for detecting the ejection of the heat-sensitive adhesive label R. The subsequent printing, transfer, and thermal activation of the heat-sensitive adhesive label R are performed in accordance with the detection of the ejection of the heat-sensitive adhesive label R by, the ejection detecting sensor S.

The thermally activating thermal head 400 and the platen roller 401 are operated by a controller (not shown) in a prescribed timing to activate the heat-sensitive adhesive layer K of the heat-sensitive adhesive label R by heat applied from the thermally activating thermal head 400, thereby exhibiting adhesive force.

After the adhesive force of the heat-sensitive adhesive label R has been exhibited by the thermally activating unit A2 with such an arrangement, indicator labels are adhered to glass bottles for liquor and medicines or plastic cases, or price tags or advertising labels are adhered. Accordingly, there is an advantage in that released sheets (liners) as in conventional general adhesive labels become unnecessary, resulting in reducing cost; and also released sheets which will be waste after use are unnecessary, having an advantage also in view of resource savings and environment.

The printing thermal head 100 of the thermal printer unit P2 and the thermally activating thermal head 400 of the thermally activating unit A2 consume relatively high electric power; accordingly, when both thermal heads are driven at the same time, the power sometimes exceeded the allowable power of the power source of the printer.

Particularly, portable printers used for printing distribution/delivery labels and so on have relatively low allowable electric power because they are driven by a built-in battery as a power source; thus, it was sometimes difficult to operate the printing thermal head and the thermally activating thermal head at the same time.

Accordingly, in the conventional portable printers, first, the printing thermal head 100 of the thermal printer unit P2 is driven to perform printing, and then the thermally activating thermal head 400 of the thermally activating unit A2 is driven to perform thermal activation, thereby covering the consumed power of each thermal head within the allowable power.

However, since the printing thermal head and the thermally activating thermal head are individually operated with a certain time difference, as described above, there was a problem of taking a long period of time until the issue of labels is completed. Particularly, printers carried by delivery servicemen issue labels and the like on the customer's premises; therefore, which requires to issue labels and so on smoothly in minimum time so as not to keep customers waiting.

SUMMARY OF THE INVENTION

The present invention has been proposed to solve the above problems. Accordingly it is an object of the present invention to provide a thermal printer having a thermally activating apparatus for a heat-sensitive adhesive sheet capable of operating a printing thermal head and a thermally activating thermal head in parallel with relatively low allowable power to reduce time until the completion of the issue of labels and so on.

In order to achieve the above object, according to the present invention, there is provided a thermal printer having a thermally activating apparatus for a heat-sensitive adhesive sheet includes: at least a thermally activating apparatus (a thermally activating unit A1) for a heat-sensitive adhesive sheet including at least an activating thermal head 40 for heating to activate a heat-sensitive adhesive layer of the heat-sensitive adhesive sheet R, the heat-sensitive adhesive sheet R having a printable plane on one side of a sheet-like substrate and the heat-sensitive adhesive layer on the other side thereof, and a transfer means for transferring the heat-sensitive adhesive sheet in a designated direction; and a printing thermal head 10 for performing thermal printing onto the printable plane of the sheet-like substrate, the thermal printer including a power-consumption estimating means (a microcomputer M and a designated program) for estimating first electric power consumption required for driving the printing thermal head and second electric power consumption required for driving the activating thermal head of the thermally activating apparatus; a supply-power setting means (the microcomputer M and a designated program) for setting first electric power that can be supplied to the printing thermal head and second electric power that can be supplied to the activating thermal head within the allowable power range on the basis of the first electric power consumption and the second electric power consumption estimated by the power-consumption estimating means; and an energization control means (the microcomputer M and a designated program) for energizing the printing thermal head and the activating thermal head on the basis of the first electric power and the second electric power set by the supply-power setting means.

Consequently, the printing thermal head and the activating thermal head can be driven in parallel within the range of allowable power, thus allowing the reduction of period of time until the completion of the issue of labels and so on formed of the heat-sensitive adhesive sheet R.

The printing thermal head and the activating thermal head include a plurality of dot-like heating devices arranged in parallel; and the power-consumption estimating means counts the number of dots driven in fixed time out of each heating device of the printing thermal head and the activating thermal head, and calculates the first electric power consumption and the second electric power consumption on the basis of the number of dots. Accordingly, the power consumption of the printing thermal head and the activating thermal head can easily be estimated.

Also, the number of dots driven in the fixed time may be counted on the basis of print data supplied from a prescribed print control means and control data of the thermally activating apparatus. This allows the number of dots varying sequentially during the issue of labels and so on to be accurately grasped, so that the power consumption of the printing thermal head and the activating thermal head can be accurately estimated. The power consumption of the activating thermal head is estimated on the basis of the control data of the thermally activating apparatus; however, this is for the purpose of including the case of activating only part (such as the rim or dots arranged at fixed intervals) of the heat-sensitive adhesive sheet in addition to the case of activating the entire surface of the heat-sensitive adhesive sheet.

The supply-power setting means may set the first electric power consumption and the second electric power consumption to the first electric power and the second electric power as they are when the total of the first electric power consumption and the second electric power consumption estimated by the power-consumption estimating means is within the allowable power; and may divide the first electric power consumption and the second electric power consumption into a designated number to set the first electric power and the second electric power when the total of the first electric power consumption and the second electric power consumption estimated by the power-consumption estimating means exceeds the allowable power. Therefore, appropriate electric power can be supplied according to the magnitude of the power consumption of each thermal head; thus, limited allowable power can efficiently be used.

The energization control means may control the first electric power and the second electric power set by the supply-power setting means so as to energize all the heating devices requiring to be driven in the printing thermal head and the activating thermal head at once when the total of the first electric power consumption and the second electric power consumption estimated by the power-consumption estimating means is within the allowable power; and may time-division control the first electric power and the second electric power set by the supply-power setting means so as to energize the heating devices requiring to be driven in the printing thermal head and the activating thermal head with a prescribed time difference when the total of the first power consumption and the second power consumption estimated by the power-consumption estimating means exceeds the allowable power. Therefore, appropriate electric power can be supplied according to the magnitude of the power consumption of each thermal head; thus, limited allowable power can efficiently be used. Particularly, when the total of the first electric power consumption and the second electric power consumption is within the allowable power, energization is controlled such that all the heating devices requiring to be driven in the printing thermal head and the activating thermal head are energized at once, thus allowing the reduction of period of time until the completion of the issue of labels and so on.

The supply-power setting means may set the first electric power consumption and the second electric power consumption to the first electric power and the second electric power as they are when each of the first electric power consumption and the second electric power consumption estimated by the power-consumption estimating means is within the allowable power; and may divide the first electric power consumption or the second electric power consumption into a designated number to set the first electric power or the second electric power when the first electric power consumption or the second electric power consumption estimated by the power-consumption estimating means exceeds the allowable power. Therefore, appropriate electric power can be supplied according to the magnitude of the power consumption of each thermal head; thus, limited allowable power can efficiently be used.

The energization control means may control the first electric power set by the supply-power setting means so as to energize all the heating devices requiring to be driven in the printing thermal head, and then control the second electric power set by the supply-power setting means to energize all the heating devices requiring to be driven in the activating thermal head when each of the first electric power consumption and the second electric power consumption estimated by the power-consumption estimating means is within the allowable power; and may time-division control the first electric power and the second electric power set by the supply-power setting means so as to energize the heating devices requiring to be driven in the printing thermal head or the activating thermal head with a prescribed time difference when the first electric power consumption or the second electric power consumption estimated by the power-consumption estimating means exceeds the allowable power. Therefore, appropriate electric power can be supplied according to the magnitude of the power consumption of each thermal head; thus, limited allowable power can efficiently be used.

Also, the printing thermal head and the activating thermal head may be formed of thermal heads having the same characteristics. Accordingly, the estimation of the power consumption by both thermal heads can easily be performed by the total of the number of dots; thus, setting of supply power and energization control can easily be performed. Also, the common use of parts can reduce manufacturing cost.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

Preferred embodiments of the present invention will be described hereinafter with reference to the drawings.

Figure 1:
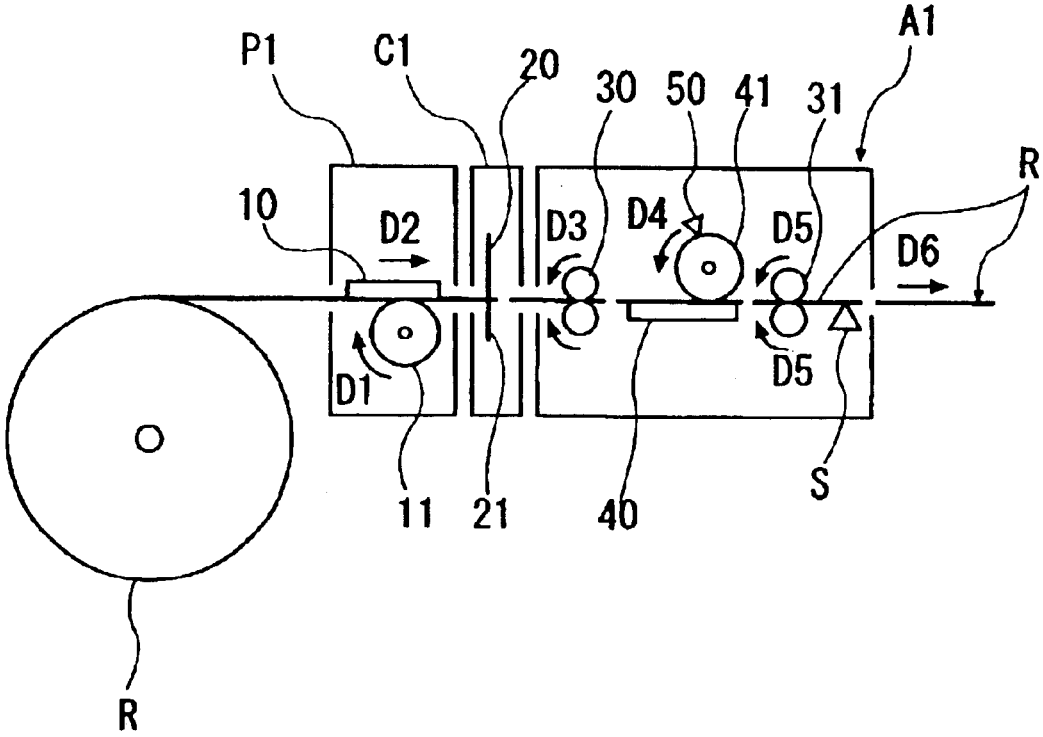
FIG. 1 is a schematic diagram showing the arrangement of a thermal printer according to the present invention.

FIG. 1 is a schematic diagram showing the arrangement of a thermal printer according to-the present invention.

In FIG. 1, reference sign P1 denotes a thermal printer unit, sign C1 indicates a cutter unit, sign A1 indicates a thermally activating unit serving as a thermally activating apparatus, and sign R indicates a heat-sensitive adhesive label wound like a roll.

The thermal printer unit P1 includes a printing thermal head 10, a platen roller 11 which is brought into pressure contact with the printing thermal head 10, and a drive system, which is not shown, (such as a pulse motor 500 (refer to FIG. 2) and a gear train or the like) for rotating the platen roller 11.

The platen roller 11 is rotated in the direction of D1 (clockwise) in FIG. 1 to draw out the heat-sensitive adhesive label R; the drawn-out heat-sensitive adhesive label R is subjected to thermal printing, and is then transferred in the direction of D2 (to the right). The platen roller 11 includes a pressurizing means, which is not shown, (such as a coil spring, a leaf spring or the like), by the urging force of which the surface of the platen roller 11 is brought into pressure contact with the printing thermal head 10.

Heating devices of the printing thermal head 10 are composed of a plurality of relatively small resistance elements arranged in parallel in the crosswise direction of the head so as to allow dot printing.

Heating devices of a thermally activating thermal head 40, which will be described later, have the same structure.

Using a resistance element with the same arrangement for the printing thermal head 10 and the thermally activating thermal head 40 facilitates the estimation of power consumption, and cost reduction by common use of parts.

Figure 7:
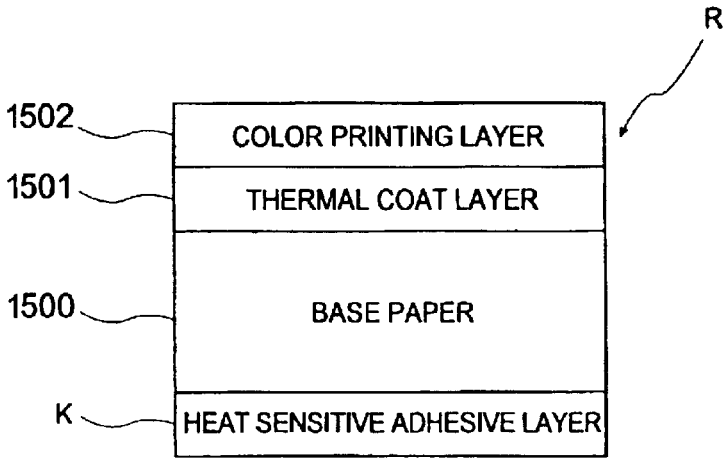
FIG. 7 is a sectional view showing a constructional example of a heat-sensitive adhesive sheet.

The heat-sensitive adhesive label R used in this embodiment has the arrangement for example as in the foregoing FIG. 7. Also, a heat insulating layer may be provided on the base paper 1500 if necessary.

The printing thermal head 10 and the printing platen roller 11 are driven on the basis of a print signal from a microcomputer M, which also serves as a print controller and will be described later, so that the thermal coat layer 1501 of the heat-sensitive adhesive label R can be subjected to desired printing.

The cutter unit C1 is used for cutting the heat-sensitive adhesive label R that has been subjected to thermal printing with the thermal printer unit P1 in an appropriate length, including a movable blade 20, a fixed blade 21 and so on, which are activated by the primary drive such as an electric motor (not shown). The movable blade 20 is driven in a designated timing by the control of the microcomputer M serving as a controller, which will be described later.

The thermally activating unit A1 is rotated, for example, by a pulse motor 600 (refer to FIG. 2) serving as the primary drive, including an inserting roller 30 and an ejecting roller 31 for inserting and ejecting the cut heat-sensitive adhesive label R, wherein the thermally activating thermal head 40 and a thermally activating platen roller 41, which is brought into pressure contact with the thermally activating thermal head 40, are disposed between the inserting roller 30 and the ejecting roller 31. The thermally activating platen roller 41 includes a drive system (such as a pulse motor 600 and a gear train), wherein the thermally activating platen roller 41 is rotated in the direction of D4 (counterclockwise in FIG. 1) to transfer the heat-sensitive adhesive label R in the direction of D6 (to the right in FIG. 1) with the inserting roller 30 and the ejecting roller 31, which rotate in the direction of D3 and D5, respectively. The thermally activating platen roller 41 includes a pressurizing means, which is not shown, (such as a coil spring and a leaf spring), by the urging force of which the surface of the thermally activating platen roller 41 is brought into pressure contact with the thermally activating thermal head 40. The thermally activating platen roller 41 is formed of, for example, hard rubber or the like.

Reference sign S indicates an ejection detecting sensor for detecting the ejection of the heat-sensitive adhesive label R. The subsequent printing, transfer, and thermal activation of the heat-sensitive adhesive label R are performed in accordance with the detection of the ejection of the heat-sensitive adhesive label R by the ejection detecting sensor S.

Sign 50 denotes a scraper serving as a removing means for a heat-sensitive adhesive G1 adhered to the thermally activating platen roller 41.

The scraper 50 is formed of either of, for example, rubber, plastic, metal, and rubber, plastic, and metal, whose surfaces are subjected to fluorocarbon polymer treatment, having a slightly larger width than the breadth of the thermally activating platen roller 41. The scraper 50 is brought into pressure contact with the surface of the thermally activating platen roller 41 by an urging means (not shown).

Figure 2:
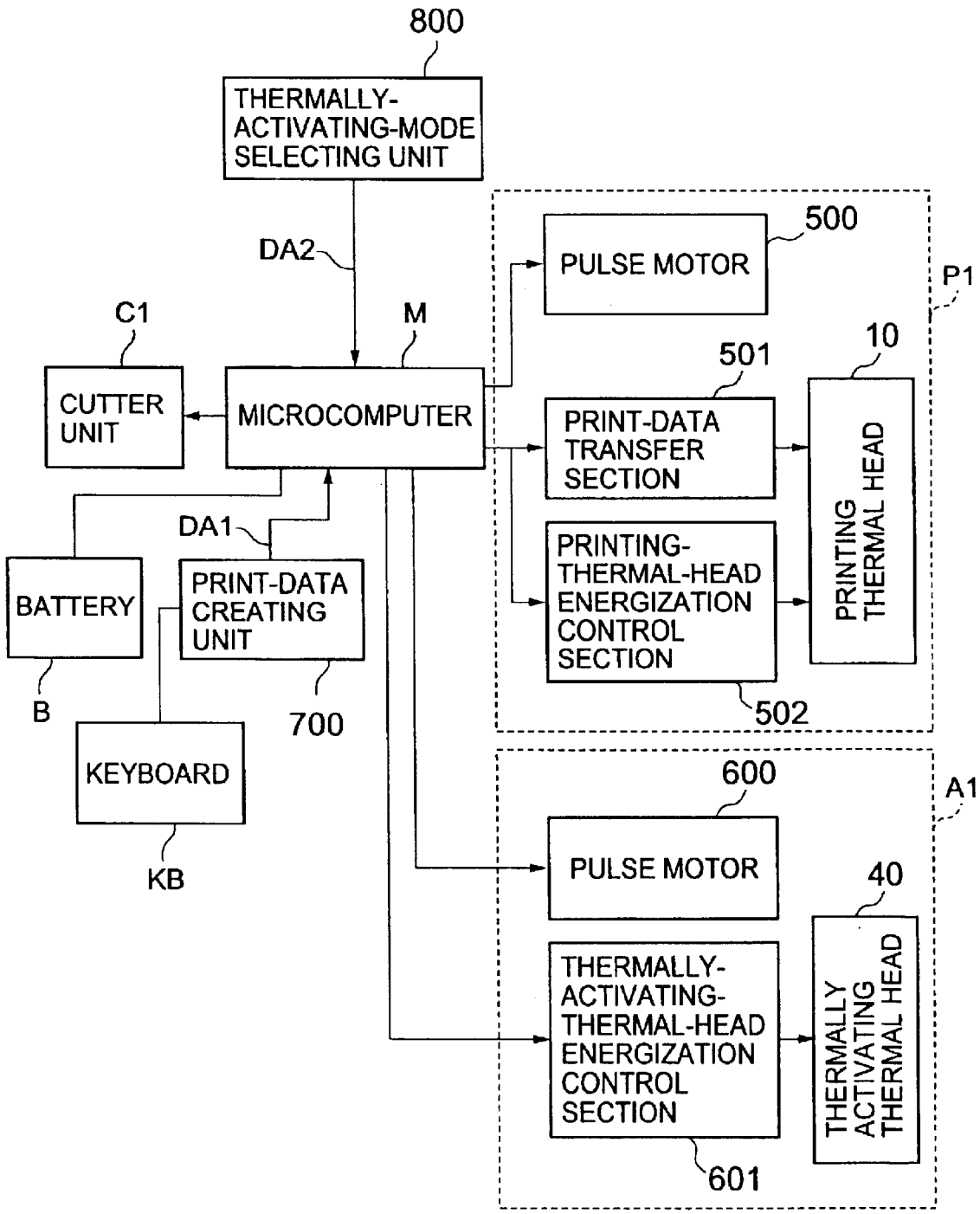
FIG. 2 is a block diagram showing the schematic structure of a control system of the thermal printer according to the present invention.

Referring to a block diagram of FIG. 2, a schematic structure of a control system of the thermal printer according to the embodiment will be described.

The operation of the thermal printer unit P1, the thermally activating unit A1, and the cutter unit C1 that constitute the thermal printer is controlled by the microcomputer M serving as a controller connected to these units.

To the microcomputer M is connected, for example, a print-data creating unit 700 for creating desired print data DA1 on the basis of input from, for example, a keyboard KB; a thermally-activating-mode selecting unit 800 for selecting a thermally activating mode with the thermally activating unit A1 (such as a mode for activating the entire surface of the heat-sensitive adhesive label R, a mode for activating only the rim of the heat-sensitive adhesive label R, and a mode for varying the density of activation); and a battery B serving as a power source, in addition to the aforesaid units P1, C1, and A1.

To the ROM provided for the microcomputer M is stored various control programs including a program (power-consumption estimating means) for estimating electric power consumed by the thermal heads 10 and 40 by calculating the number of dots of the printing thermal head 10 that is driven in the fixed time and the number of dots of the thermally activating thermal head 40 that is driven in the fixed time on the basis of the print data DA1 from the print-data creating unit 700 and the control data DA2 from the thermally-activating-mode selecting unit 800; based on the estimation results, a program (supply-power setting means) for calculating electrical power that can be supplied to the thermal heads 10 and 40 within the range of allowable power of the battery B; and a program (energization control means) for determining the allocation when each dot of the printing thermal head 10 and the thermally activating thermal head 40 is time division driven, in addition to a control program for operating the pulse motor 500 of the thermal printer unit P1, the pulse motor 600 of the thermally activating unit A1, and the motor (not shown) of the cutter unit C1 in a prescribed timing.

The control system of the thermal printer unit P1 includes a print-data transfer section 501 for inputting the print data DA1 to the printing thermal head 10 and an energization control section 502 for controlling electric power to be supplied to the printing thermal head 10.

The control system of the thermally activating unit A1 includes an energization control section 601 for controlling electric power to be supplied to the thermally activating thermal head 40.

Upon the start of the operation of the thermal printer, the thermal printer unit P1 performs thermal printing onto the printable plane (thermal coat layer 1501) of the heat-sensitive adhesive label R by the control of the microcomputer M. At that time, the heating devices of the printing thermal head 10 are energized all at once in response to the number of dots required for printing, or alternatively, are sequentially energized by time division for thermal printing in accordance with the procedure set by a thermal-head driving process, which will be described later.

Next, the heat-sensitive adhesive label R that has been transferred to the cutter unit C1 by the rotation of the printing platen roller 11 is cut in a predetermined length with the movable blade 20 which operates in a prescribed timing.

Subsequently, the cut heat-sensitive adhesive label R is taken into the thermally activating unit A1 by the inserting roller 30 of the thermally activating unit A1 and is subjected to thermal energy by the thermally activating thermal head 40 (heating devices) and the thermally activating platen roller 41 which are driven in a prescribed timing by the control of the microcomputer M. This allows the heat-sensitive adhesive layer K of the heat-sensitive adhesive label R to be activated to exhibit adhesive force. At that time, the heating devices of the thermally activating thermal head 40 are energized all at once in response to the number of dots required for activation, or alternatively, are sequentially energized by time division for thermal activation in accordance with the procedure set by a thermal-head driving process, which will be described later.

Subsequently, the heat-sensitive adhesive label R is ejected to the exterior of the thermal printer by the operation of the ejecting roller 31.

Figure 3:
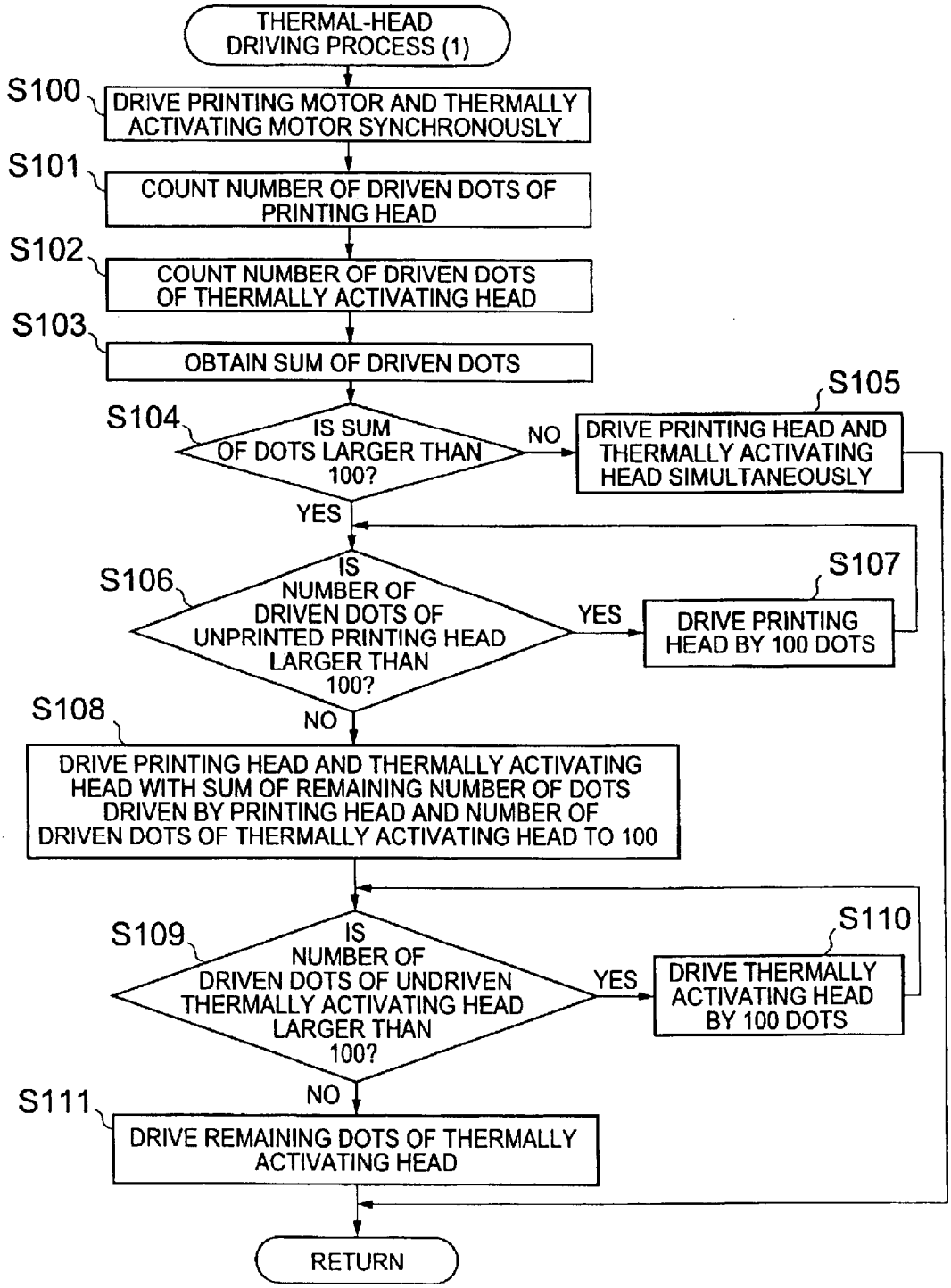
FIG. 3 is a flowchart showing the procedure of a thermal-head driving process (1)

Here, the procedure of a thermal-head driving process (1) performed by the microcomputer M will be described with reference to the flowchart of FIG. 3.

In order to simplify the explanations, the thermal printer of this embodiment employs thermal heads having the same characteristics as the printing thermal head 10 and the thermally activating thermal head 40, wherein the allowable power of the built-in battery B can simultaneously operate the thermal heads by 100 dots, the printing motor (pulse motor 500) and the thermally activating motor (pulse motor 600) employ a synchronous drive system, and one pixel can be printed in one step of the motors.

Upon the start of the thermal-head driving process (1), first, in step S100, the printing motor (pulse motor 500) of the thermal printer unit P1 and the thermally activating motor (pulse motor 600) of the thermally activating unit A1 are driven synchronously, and the process goes to step S101.

In step S101, the number of dots driven in the printing thermal head 10 is counted on the basis of the print data DA1 from the print-data creating unit 700, and then the process goes to step S102.

In step S102, the number of dots driven in the thermally activating thermal head 40 is counted on the basis of the control data DA2 from the thermally-activating-mode selecting unit, and then the process goes to step S103.

In step S103, the total (sum) of the number of the driven dots that have been counted in step S101 and step S102 mentioned above is calculated, and then the process goes to step S104.

In step S104, it is determined whether the sum of the numbers of dots is larger than the maximum number 100 of dots driven by the allowable power. When it has been determined to be smaller (that is "NO"), it is determined that both the thermal heads 10 and 40 can be driven by the allowable power of the battery B, and the process goes to step S105 to energize the required dots for the printing thermal head 10 and the thermally activating thermal head 40 all at once, thereby simultaneously driving them, and the process is returned. This allows time required for printing and thermal activation to be reduced and the labels to be issued at a high speed.

On the other hand, in step S104, when it has been determined that the sum of the numbers of the dots is larger (that is, "YES") than the maximum number 100 of dots driven by the allowable power, the process goes to step S106.

In step S106, it is determined whether the number of unprinted driven dots is larger than 100. When it has been determined to be larger, the process goes to step S107 to drive the dots required for the printing thermal head 10 by 100 dots; then the process is returned to step S106; and the similar processes are repeated until the number of driven dots of the unprinted printing thermal head 10 becomes smaller than 100. Therefore, the printing thermal head 10 can efficiently be driven within the range of allowable power of the battery B.

In step S106, it has been determined that the number of dots driven in the unprinted printing thermal head 10 had become smaller than 100, the process goes to step S108.

In step S108, 30 dots of the thermally activating thermal head are added to the remaining number of dots (for example, "70") driven by the printing thermal head 10 to obtain "100" as the number of driven dots, and they are driven.

Subsequently, the process goes to step S109, in which it is determined whether the number of driven dots in the undriven thermally activating thermal head 40 is lager than 100. When it has been determined to be larger, the process goes to step S110, where required dots for the thermally activating thermal head 40 are driven by 100 dots; then the process is returned to step S109; and similar processes are repeated until the number of driven dots of the undriven thermally activating thermal head 40 becomes smaller than 100. Therefore, the thermally activating thermal head 40 can efficiently be driven within the range of allowable power, of the battery B.

Then, when it has been determined that the number of driven dots of the undriven thermally activating thermal head 40 had become smaller than 100, the process goes to step S110 to drive the remaining dots; then the process is returned and the similar processes are repeated on the basis of the following print data DA1 and the control data DA2 for the thermally activating thermal head.

According to the thermal-head driving process (1), as described above, the power consumption (the number of driven dots) of the printing thermal head and the activating thermal head is estimated (counted); and the printing thermal head and the activating thermal head can be driven in parallel within the range of allowable power; thus, time until the completion of issuing labels and so on can be reduced.

Next, another embodiment of the thermal-head driving process will be described.

In a thermal-head driving process (2) according to this embodiment, the printing thermal head 10 and the thermally activating thermal head 40 are time-division driven according to the number of the driven dots of each thermal head in place of time-division driving the thermal heads according to the sum of driven dots of the thermal heads 10 and 40 as in the first embodiment.

Figure 4:
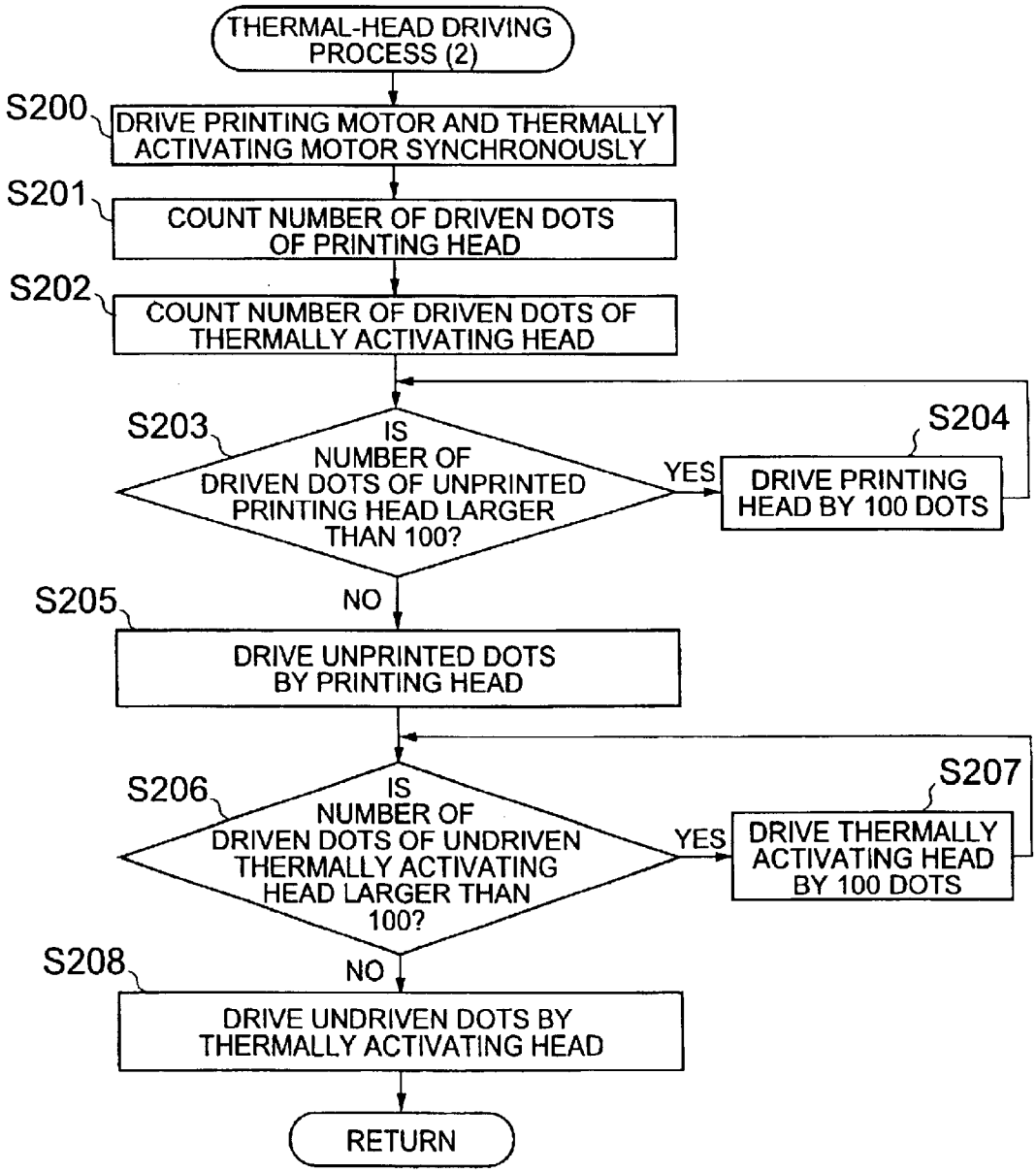
FIG. 4 is a flowchart showing the procedure of a thermal-head driving process (2)

The procedure will be described with reference to the flowchart of FIG. 4. First, in step S200, the printing motor (pulse motor 500) of the thermal printer unit P1 and the thermally activating motor (pulse motor 600) of the thermally activating unit A1 are driven synchronously, and the process goes to step S201.

In step S201, the number of dots driven in the printing thermal head 10 is counted on the basis of the print data DA1 from the print-data creating unit 700, and then the process goes to step S202.

In step S202, the number of dots driven in the thermally activating thermal head 40 is counted on the basis of the control data DA2 for the thermally activating thermal head from the thermally-activating-mode selecting unit, and then the process goes to step S203.

In step S203, it is determined whether the number of dots driven in the unprinted printing thermal head 10 is larger than the maximum number 100 of dots driven by the allowable power. When it has been determined to be larger, the process goes to step S204 to drive the printing thermal head 10 by 100 dots; then the process is returned to step S203; and the similar processes are repeated until the number of driven dots of the unprinted printing thermal head 10 becomes smaller than 100. Therefore, the printing thermal head 10 can efficiently be driven within the range of allowable power of the battery B.

In step S203, when it has been determined that the number of dots driven in the unprinted printing thermal head 10 is smaller than 100, it is determined that the printing thermal head 10 can be driven by the allowable power of the battery B, and the process goes to step S205, where the unprinted required dots of the printing thermal head 10 are energized for activation.

In step S206, it is determined whether the number of dots driven in the undriven thermally activating thermal head 40 is larger than 100 according to the count results in the foregoing step S202. When it has been determined to be larger, the process goes to step S207, where the required dots for the thermally activating thermal head 40 is driven by 100 dots; the process is returned to step S206; and the similar processes are repeated until the number of driven dots of the undriven thermally activating thermal head 40 becomes smaller than 100. Therefore, the thermally activating thermal head 40 can efficiently be driven within the range of the allowable power of the battery B.

Subsequently, when it has been determined that the number of driven dots of the undriven thermally activating thermal head 40 had become smaller than 100, the process goes to step S208 to drive the remaining dots, and the process is returned, where the similar processes are repeated on the basis of the following print data DA1 and the control data DA2 for the thermally activating thermal head.

According to the thermal-head driving process (2), as described above, the power consumption (the number of driven dots) of the printing thermal head and the activating thermal head is estimated (counted); and the printing thermal head and the activating thermal head can be driven by time division within the range of the allowable power; thus, limited allowable power can efficiently be used.

While the invention that has been made by the inventor was specifically described on the basis of the embodiments, it is not limited to the aforesaid embodiments, but can be modified variously without departing from the spirit and the scope of the present invention.

Figure 5:
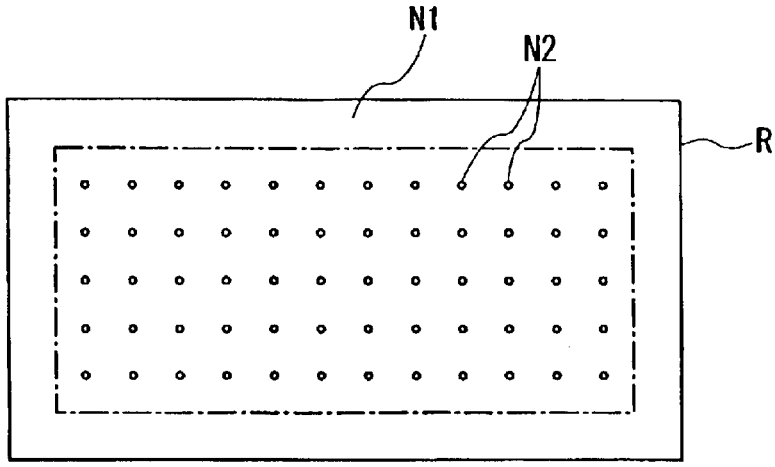
FIG. 5 is an explanatory diagram showing an example of a thermally activating range selectable by a thermally-activating-mode selecting unit.
Figure 6:
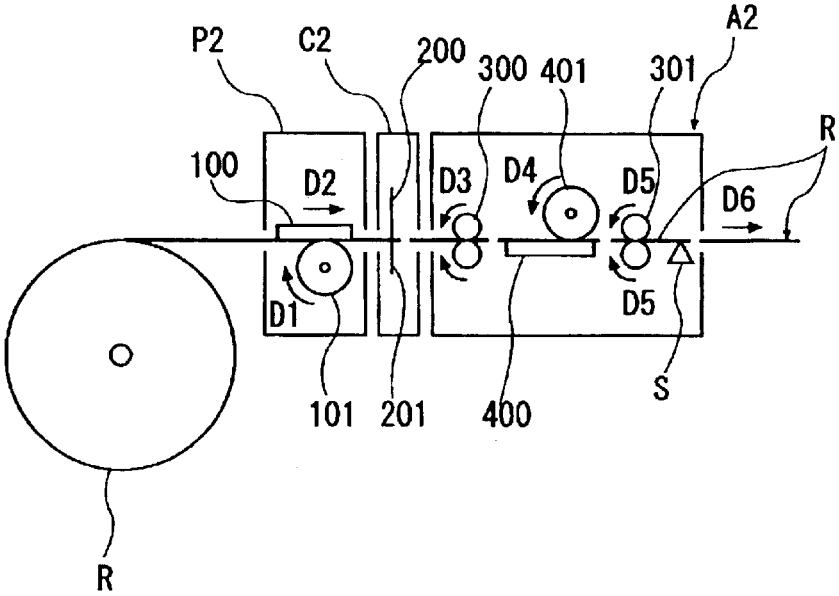
FIG. 6 PRIOR ART
FIG. 6 is a schematic diagram showing the arrangement of a conventional thermal printer.

For example, the range of thermal activation by the activating thermal head 40, which can be selected by the thermally-activating-mode selecting unit 800, may be the rim N1 with a designated width of the heat-sensitive adhesive label R, or alternatively, may be activated in a dot-like N2 with a prescribed density, as shown in FIG. 5. Therefore, the number of driven dots in the activating thermal head 40 can be reduced, so that limited allowable power can be used more efficiently.

It is also possible to alternately drive the printing thermal head 10 and the activating thermal head 40 by time division within the range of the allowable power of the battery B (within 100 dots in the above embodiment).

Needless to say, the conditions for the thermal printers in the above embodiments are only one example (thermal heads having the same characteristics are employed as the printing thermal head 10 and the thermally activating thermal head 40; the allowable power of the built-in battery B can simultaneously drive the thermal heads by 100 dots; the printing motor and the thermally activating motor employ a synchronous drive system; and one pixel can be printed in one step of the motors.). The present invention can be applied even if these conditions are changed (for example, thermal heads having different characteristics are employed as the printing thermal head 10 and the thermally activating thermal head 40; the allowable power of the built-in battery B is varied; and the printing motor and the thermally activating motor are driven asynchronously).

As described above, a thermal printer having a thermally activating apparatus for a heat-sensitive adhesive sheet according to the present invention includes: at least a thermally activating apparatus for a heat-sensitive adhesive sheet including at least an activating thermal head for heating to activate a heat-sensitive adhesive layer of the heat-sensitive adhesive sheet, the heat-sensitive adhesive sheet having a printable plane on one side of a sheet-like substrate and the heat-sensitive adhesive layer on the other side thereof, and a transfer means for transferring the heat-sensitive adhesive sheet in a designated direction; and a printing thermal head for performing thermal printing onto the printable plane of the sheet-like substrate, the thermal printer including: a power-consumption estimating means for estimating first electric power consumption required for driving the printing thermal head and second electric power consumption required for driving the activating thermal head of the thermally activating apparatus; a supply-power setting means for setting first electric power that can be supplied to the printing thermal head and second electric power that can be supplied to the activating thermal head within the allowable power range on the basis of the first electric power consumption and the second electric power consumption estimated by the power-consumption estimating means; and an energization control means for energizing the printing thermal head and the activating thermal head on the basis of the first electric power and the second electric power set by the supply-power setting means. Consequently, there is an advantage of reducing time until the completion of the issue of labels and so on by driving the printing thermal head and the activating thermal head in parallel within the range of allowable power.

What is claimed is:

1. A thermal printer comprising:

a thermally activating apparatus for a heat-sensitive adhesive sheet including at least an activating thermal head for heating to activate a heat-sensitive adhesive layer of the heat-sensitive adhesive sheet, the heat-sensitive adhesive sheet having a printable plane on one side of a sheet-like substrate and the heat-sensitive adhesive layer on the other side thereof, and a transfer means for transferring the heat-sensitive adhesive sheet in a designated direction;

a printing thermal head for performing thermal printing onto the printable plane of the sheet-like substrate;

a power-consumption estimating means for estimating first electric power consumption required for driving the printing thermal head and second electric power consumption required for driving the activating thermal head of the thermally activating apparatus;

a supply-power setting means for setting first electric power that can be supplied to the printing thermal head and second electric power that can be supplied to the activating thermal head within the allowable power range on the basis of the first electric power consumption and the second electric power consumption estimated by the power-consumption estimating means; and an energization control means for energizing the printing thermal head and the activating thermal head on the basis of the first electric power and the second electric power set by the supply-power setting means.

2. A thermal printer according to claim 1, wherein the printing thermal head and the activating thermal head include a plurality of dot-like heating devices arranged in parallel, and the power-consumption estimating means counts the number of dots driven in fixed time out of each heating device of the printing thermal head and the activating thermal head, and calculates the first electric power consumption and the second electric power consumption on the basis of the number of dots.

3. A thermal printer according to claim 2, wherein the number of dots driven in the fixed time is counted on the basis of print data supplied from a prescribed print control means and control data of the thermally activating apparatus.

4. A thermal printer according to claim 2, wherein the supply-power setting means sets the first electric power consumption and the second electric power consumption to the first electric power and the second electric power as they are when the total of the first electric power consumption and the second electric power consumption estimated by the power-consumption estimating means is within the allowable power, and divides the first electric power consumption and the second electric power consumption into a designated number to set the first electric power and the second electric power when the total of the first electric power consumption and the second electric power consumption estimated by the power-consumption estimating means exceeds the allowable power.

5. A thermal printer according to claim 4, wherein the energization control means controls the first electric power and the second electric power set by the supply-power setting means so as to energize all the heating devices requiring to be driven in the printing thermal head and the activating thermal head at once when the total of the first electric power consumption and the second electric power consumption estimated by the power-consumption estimating means is within the allowable power, and time-division controls the first electric power and the second electric power set by the supply-power setting means so as to energize the heating devices requiring to be driven in the printing thermal head and the activating thermal head with a prescribed time difference when the total of the first electric power consumption and the second electric power consumption estimated by the power-consumption estimating means exceeds the allowable power.

6. A thermal printer according to claim 2, wherein the supply-power setting means sets the first electric power consumption and the second electric power consumption to the first electric power and the second electric power as they are when each of the first electric power consumption and the second electric power consumption estimated by the power-consumption estimating means is within the allowable power, and divides the first electric power consumption or the second electric power consumption into a designated number to set the first electric power or the second electric power when the first electric power consumption or the second electric power consumption estimated by the power-consumption estimating means exceeds the allowable power.

7. A thermal printer according to claim 6, wherein the energization control means controls the first electric power set by the supply-power setting means so as to energize all the heating devices requiring to be driven in the printing thermal head, and then controls the second electric power set by the supply-power setting means to energize all the heating devices requiring to be driven in the activating thermal head when each of the first electric power consumption and the second electric power consumption estimated by the power-consumption estimating means is within the allowable power, and time-division controls the first electric power and the second electric power set by the supply-power setting means so as to energize the heating devices requiring to be driven in the printing thermal head or the activating thermal head with a prescribed time difference when the first electric power consumption or the second electric power consumption estimated by the power-consumption estimating means exceeds the allowable power.

8. A thermal printer according to claim 1, wherein the printing thermal head and the activating thermal head are formed of thermal heads having the same characteristics.

* * * * *